United States Patent [19]

Dumenigo

[11] Patent Number: 4,948,078

[45] Date of Patent: Aug. 14, 1990

[54] ARTICLE SUPPORT

[76] Inventor: Mayra Dumenigo, 530 W. Park Dr., Apt. 190 104, Miami, Fla. 33172

[21] Appl. No.: 402,063

[22] Filed: Sep. 1, 1989

Related U.S. Application Data

[63] Continuation-in-part of Ser. No. 272,391, Nov. 17, 1988, abandoned.

[51] Int. Cl.[5] ..... A47K 5/08

[52] U.S. Cl. ..... 248/176; 248/581; 15/257.05

[58] Field of Search ..... 248/176, 581; 220/93, 220/20.5; 15/257.05, 257.06

[56] References Cited

U.S. PATENT DOCUMENTS

| | | | |
|---|---|---|---|
| 293,650 | 2/1884 | Gorman | 15/257.05 |
| 729,417 | 5/1903 | Rivers | 220/20.5 X |
| 860,838 | 7/1907 | Spingler | 15/257.06 |
| 1,065,823 | 6/1913 | Matthews | 15/257.05 X |
| 2,778,050 | 1/1957 | Meinhardt | 15/257.06 X |
| 2,994,901 | 8/1961 | Ely | 15/257.05 |
| 3,761,995 | 10/1973 | Rinard | 15/257.06 |
| 4,356,588 | 11/1982 | Martucci | 15/257.06 |
| 4,424,949 | 1/1984 | Kimmett et al. | 15/257.06 X |
| 4,831,681 | 5/1989 | Puder | 15/257.05 |

*Primary Examiner*—David M. Purol
*Attorney, Agent, or Firm*—Malloy & Malloy

[57] ABSTRACT

An article support in the form of a container with an open, upwardly facing mouth and a platform in the container spanning the zone within the container below the mouth in a normal position into which it is spring urged with the platform being yieldable for a downward movement exerted upon it, as by pushing a sponge downwardly to a level of soapy water for example, in the container so that the sponge may be utilized and replaced on the normally elevated platform to dry.

4 Claims, 3 Drawing Sheets

ARTICLE SUPPORT

BACKGROUND OF THE INVENTION

This is a continuation-in-part application of patent application Ser. No. 272,391 filed on Nov. 17, 1988 now abandoned.

FIELD OF THE INVENTION

This invention relates to an article support which includes a spring urged elevated platform on which an article, such as a sponge, may be positioned to be held in a dry condition but yieldable to move downwardly into soapy water to wet the sponge for use in washing dishes or other household chores.

DESCRIPTION OF THE PRIOR ART

There has long been a need for a solution to the problem of wet, damp sponges in kitchens and bathrooms for example. This invention is of a container with an open mouth which is spanned by a platform in the container which is spring urged into an elevated position above the level of a supply of soapy water in the container so that, when it is desired to use the sponge, one merely pushes the sponge on the platform downwardly below the level of the soapy water so that it becomes moistened in whole or in part and can be conveniently used and replaced on the elevated platform to dry.

Existing U.S. Patents evidencing prior art structures include Gorman, 293,650, disclosing a pen cleaner with a receptacle supported within an outer container by a single spring having an upper end attached to the lower end of the receptacle and a lower end attached to the floor of the outer container wherein the spring is not retained thereby lending instability to the subject invention. Similarly, Meinhardt, 2,778,050, discloses a paint applicator with a bias platform communicating with paint within a paint type tray and having at least one end secured to a spring generally in the form of a triangle which is not restrained for vertical movement in any manner.

The patent to Ely, 2,994,904, discloses a loading means for fluid applicator including an apertured platform which is not spring bias but which is apertured to provide access to the liquid within the outer container.

Spingler, 860,838, discloses a moistener and casing for press copying rollers including a platform which is apertured for communication with liquid within a tray like container and wherein two spaced apart, parallel support members, rather than springs, engage the underportion thereof.

Martucci, 4,356,588, discloses a dripless ceiling paint roller and paint metering can, again having a apertured platform on which the roller may be positioned and further wherein only one end of the apertured tray, 26, is spring bias apparently to affect a tilting action and movement of the apertured member 26 into the paint contained within the outer tray.

Matthews, 1,065,823, discloses a paper hanger paste bucket having an inner platform which is apertured. Similarly, Rivers, 729,417, discloses an outer container having an apertured support platform which is biased by springs. Neither Matthews nor Rivers, when considered together or separately, disclose the concept of a plurality of springs which are specifically restrained for vertical movement only as is the platform which they support.

The present device also differs from the above-noted structure by saving soap, especially liquid soap, which it will be realized is often applied to a sponge directly from a container. Using this invention, the container may contain a supply of soapy water, so that when the platform is depressed, the sponge is soaped and ready to use instead of repeatedly applying more concentrated liquid soap that has not been diluted by water as is the case of the water in the container. In addition to saving soap, the present invention greatly reduces the amount of water used during washing and rinsing. Normally, when liquid soap is applied directly to a sponge or an article being washed, a great deal of water is needed to wash away the high concentration of soap. In using this invention, with the soap and water solution already mixed in the container, a person need only soap the sponge by depressing the platform, wipe the surface to be cleaned and then quickly rinse the surface to wash off the soapy water solution. In this manner, only a minimal amount of soap and water are used during the washing and rinsing process. Further, the sponge may be cleaned after use and replaced on the platform instead of remaining wet or in water which hastens its deterioration.

It is accordingly an object of this invention to provide an article holder for maintaining an article such as a sponge in a position which is dry but which can be changed by pushing it downwardly into soapy water for example, which is inexpensive to manufacture, very decorative and highly useful especially in bathrooms and kitchens.

BRIEF DESCRIPTION OF THE DRAWINGS

For a fuller understanding of the nature of the present invention, reference should be had to the detailed description of the accompanying drawings in which.

Like reference numerals refer to like parts throughout the several views of the drawings.

DESCRIPTION OF THE PREFERRED EMBODIMENT

Figure 1:
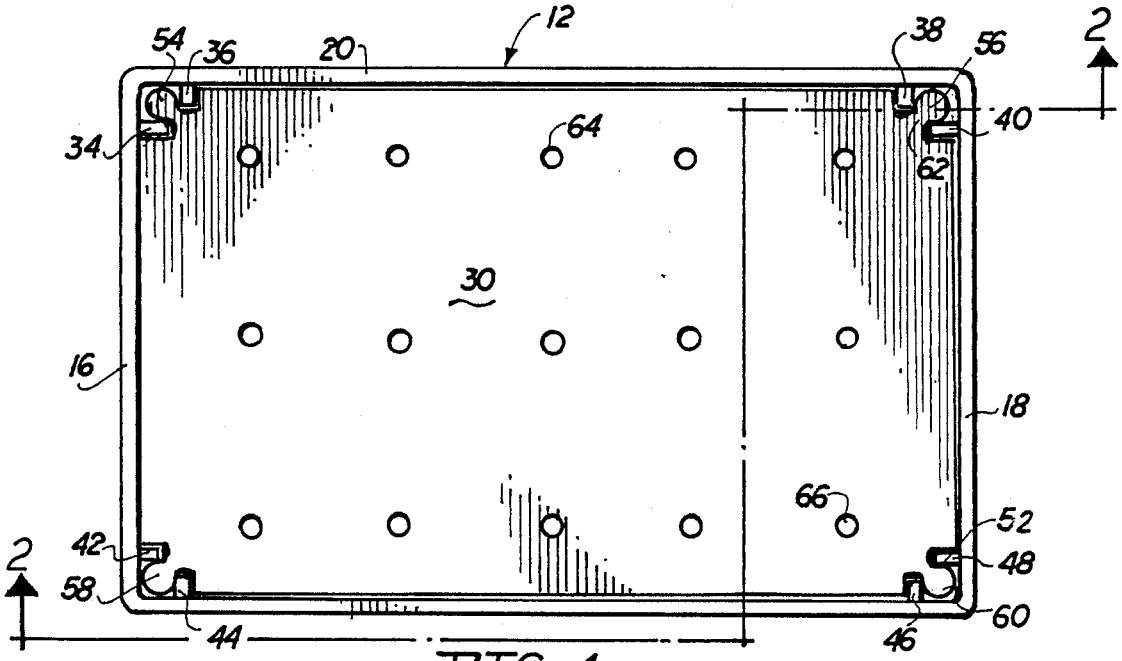
FIG. 1 is a top plan view of one embodiment of the present invention.
Figure 3:
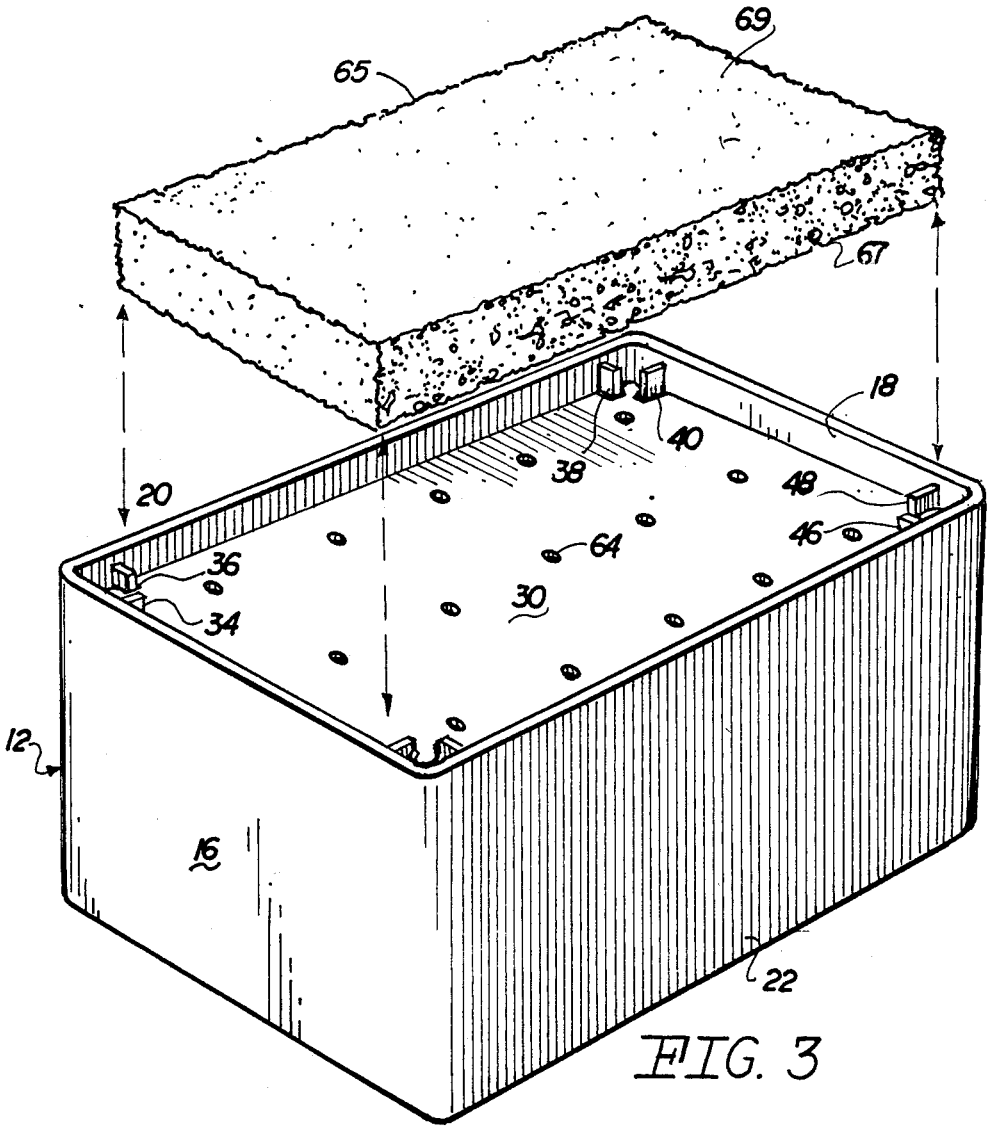
FIG. 3 is a perspective view of the embodiment of FIG. 1 with a sponge to be supported shown in exploded form relative thereto.
Figure 2:
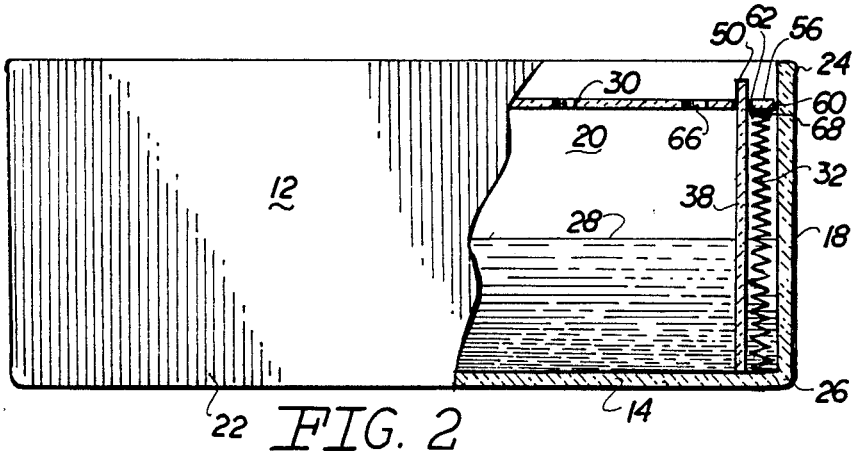
FIG. 2 is a side view in partial section and cut-away showing interior details of the embodiment of FIG. 1.
Figure 4:
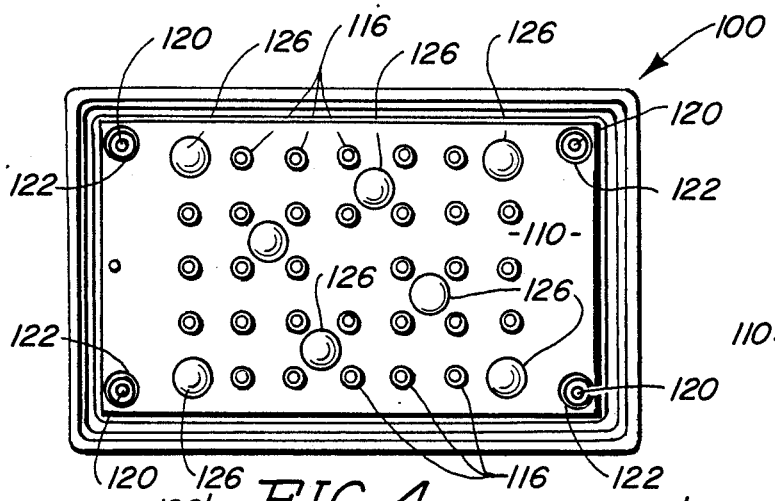
FIG. 4 is a top plan view of yet another embodiment of the present invention.
Figure 5:
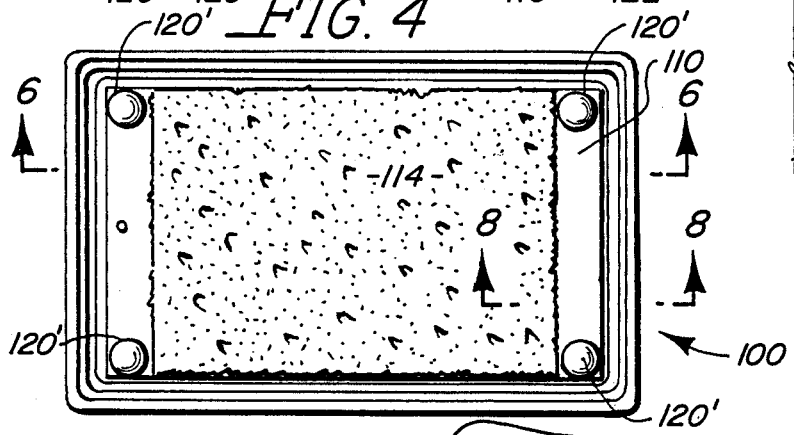
FIG. 5 is a top plan view of the embodiment of FIG. 4 with a supported sponge or like member thereon.

Referring to the drawings wherein like reference characters designate corresponding parts in the views, and referring particularly to FIG. 2, it is seen that a container or vessel 12 is provided. It has a bottom 14 and two pairs of upstanding, confronting walls, a pair of end walls 16 and 18, and a pair of side walls 20 and 22. Preferably the walls are inclined upwardly and outwardly to facilitate stacking and terminate at an upper outwardly flared rim 24 defining an open mouth. Also, the juncture of the walls and the floor are provided with a radius as at 26. The vessel may hold water 28 as shown, which for certain uses will be soapy.

Within the vessel or container there is a platform 30 which is spring urged to a normal elevated position, as shown, by spring means. In the preferred embodiment shown, four springs, such as that designated by the numeral 32 in FIG. 2, are captivated respectively by vertically extending pairs of open partial septum pairs, one being in each corner of the vessel. The partial septum means are designated by the numerals 34, 36; 38, 40; 42, 44; and 46, 48. Each of the pairs of septums is of a common height and fitness and preferably integral with the container extending upwardly from the bottom and adjacent walls at each corner terminating at upper ends, such as 50. Between the outer vertical faces of each pair, a mouth 52 is defined. The platform which may be planar has a projection at each corner, 54, 56, 58 and 60, defining a neck and outer enlarged portion. The platform is sized to substantially span the walls and the projections are sized to be received respectively in the space between each pair of partial septums with the neck being received in the mouth, such as 52 between each pair of partial septum walls. Thus, the platform is constrained to vertical movement only between the normal position shown in FIG. 2 to a lowered position below the water level 28. The platform 30 is provided with a pattern of holes, preferably, such as those designated by the numeral 64 and 66. Four springs such as that designated by the numeral 32 support the platform and preferably there is a dependent portion at each corner of the platform (see 68) to dwell within the end opening of each spring.

In use, soapy water may be in the vessel and a sponge 65, for example, may be supported on the platform, it being noted that the platform is at a height above the water so that the article such as the sponge, will be normally dry. When it is desired to use the sponge, it is pushed down together with the platform to below the water level where one end of it, for example, may be immersed in the soapy water so that it can be used and replaced on the platform where it will dry for the next use. The vessel and platform may be of any suitable material such as plastic or metal and be of a selected decorator color. It may be translucent, but in any event there is provided a simple and inexpensive article support to keep articles dry when not in use. For example, a sponge having a lower portion which is a scouring pad 67 and an upper sponge portion 69 may be provided.

While the instrument is shown and described in what is considered to be a practical and preferred embodiment, it is recognized that departures may be made within the spirit and scope of this invention which is, therefore, not to be limited except as set forth in the claims hereinafter and within the doctrine of equivalents.

Figure 6:
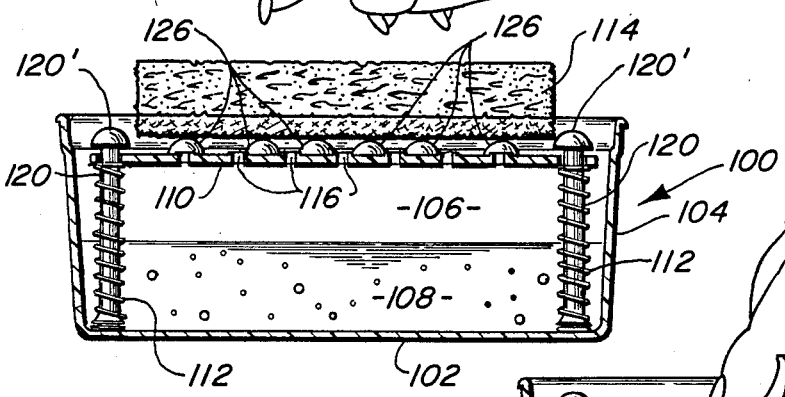
FIG. 6 is a sectional view along line 6—6 of FIG. 5.
Figure 7:
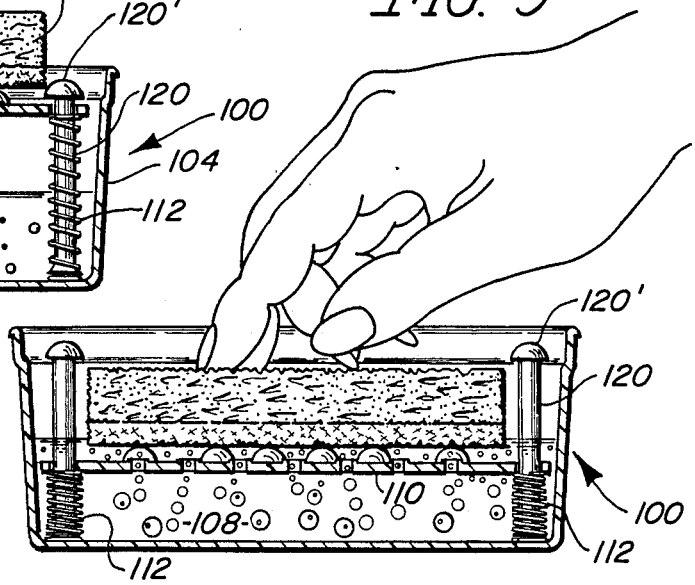
FIG. 7 is the embodiment of FIG. 6 with the supported platform in a retracted position.

Another preferred embodiment of the present invention is shown in FIGS. 4 through 8 and comprises a container 100 including a floor 102 and surrounding side wall means 104. The floor 102 and the side wall means 104 defines a substantially hollow interior 106 in which a liquid which may be mixed with detergent or like substance as at 108 is contained. A platform 110 is defined by an integral one-piece construction and is congruently configured and dimensioned so as to fit and move vertically within the interior of the container 100. The relative dimensions between the platform 110 and the interior surface of the side wall means 104 is such that the outer periphery along its entire length is spaced from the inner surface of the side wall means 104 so as to facilitate the vertical movement as set forth above. The platform 110 is supported between a normal outer position shown in FIG. 6 and an inner retracted position as shown in FIG. 7. In order to accomplish this support, a support means in the form of a plurality of springs 112 are disposed to extend upwardly from the floor 102 into engagement with an under portion with the platform 110. The springs 112 are structured and dimensioned to normally bias the platform 110 in the normal, outer position and are substantially equally structured such that the platform remains in a somewhat level state as clearly shown in FIGS. 6, 7 and 8. The platform is large enough to support a sponge or like member 114 on the top thereof and further, the platform has an apertured construction as at 116 through which the liquid 108 passes when the platform 110 is forced against the biasing force of the springs 112 into contact with the liquid 108 as best shown in FIG. 7. In order to maintain the springs in the desired position and thereby insure that the platform will only move in a vertical direction and in a substantial level orientation, a retaining means is provided in the form of a plurality of posts 120. The posts are positioned in each of four corners and in spaced apart relation to one another and the bottom end of each post 120 is secured to and extends upwardly from the inner surface of the floor 102. Each of the posts has a substantially equal longitudinal dimension which is sufficient in length to extend through a receiving aperture 122 formed in each corner of the platform 110 as clearly shown in FIGS. 6, 7 and 8. Therefore, the stability of the platform 110, whether in its normal position as shown in FIG. 6 or its inner position as shown in FIG. 7, will always be maintained at a somewhat level orientation. The retaining means in the form of each of the posts serves to have one of the plurality of springs 112 mounted in concentric, surrounding relation thereabout and extending along at least a major portion of the length thereof. Therefore, it should be apparent that the springs may compress and expand only along the length of the respective posts 120 to which they are attached, which again insures a stable vertical movement only of the platform 110.

Other features of the present invention include outer projections as at 126 integrally formed in the platform and extending outwardly from the exposed outer face thereof. These projections 126 are provided to substantially space the sponge 114 or other object being supported from full confronting engagement with the outer surface of the platform 110 as clearly shown in FIGS. 6 and 8.

Figure 8:
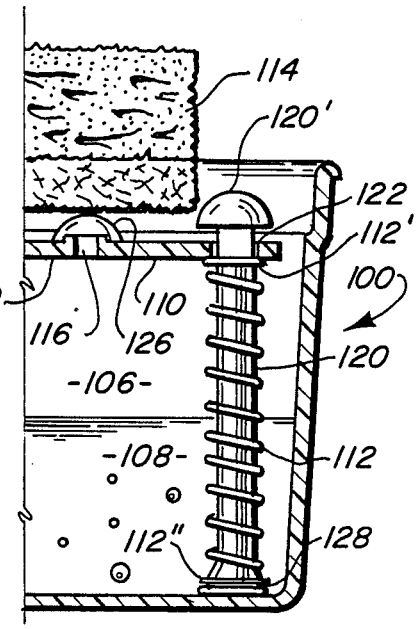
FIG. 8 is a sectional view along line 8—8 of FIG. 5.

Other features of the present invention further include the upper end of the spring 112 being either enlarged or substantially flared as at 112' (see FIG. 8) so as not to pass through the aperture 122 and maintain a supporting engagement with the undersurface of the platform 110. Further, the opposite end of the spring 112 as at 112" is secured to a ring like flange 128 integrally formed on the lower end of each of the posts 120 as also shown in FIG. 8. This anchoring or securement of each of the coil springs prevents their inadvertent dislodgment and maintains the corresponding positioning of each of the springs 112 in supported engagement with the undersurface of the platform 110.

Figure 9:
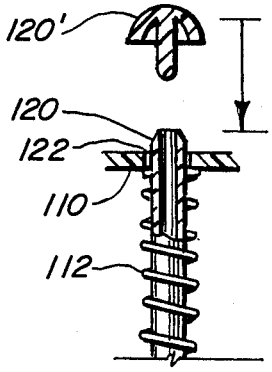
FIG. 9 is a sectional view in partial cut-away and exploded form of a structural detail of the subject assembly.

Yet another feature of the present invention includes an enlarged head portion 120' removably secured to an upper or outer end of each of the posts 120. Removable attachment of the head portion occurs by an elongated pin 130 integrally formed on and extending outwardly from an underportion of each of the heads 120'. This pin 130 fits into the interior of the upper end of the posts 120, as best shown in FIG. 9.

Now that the invention has been described,

What is claimed is:

1. A container for holding liquid therein and comprising:

a. a hollow interior bounded by a floor and a wall means secured to and upstanding from a periphery of said floor for defining boundaries of said hollow interior, b. said wall means including an upper peripheral edge defining an open mouth spaced from and oppositely disposed to said floor, c. a platform having an exposed outer surface for support of an object thereon, said platform movably mounted within said hollow interior in spaced relation to said open mouth and said floor and being congruently configured to said floor and dimensioned to be disposed in spaced relation from an inner surface of said wall means, said platform further comprising a plurality of apertures formed therein for passage of liquid flow therethrough to the object on said exposed outer surface, d. support means movably supporting said platform within said hollow interior and including a plurality of springs mounted within said hollow interior and extending upwardly from said floor into supporting relation with said platform, e. retaining means mounted within said hollow interior and including one post formed in each of four corners of said floor and extending upwardly through a receiving opening in a corresponding corner of said platform and dimensioned to pass through said platform along the length of said post, said springs being concentrically mounted in surrounding relation one each of said post, f. each of said posts comprising an enlarged head portion formed on an outer end thereof and being sufficiently dimensioned to prevent passage of said platform therebeyond, said head portions including a pin extending inwardly from an underportion thereof and dimensioned to be disposed in frictional, retaining engagement within the interior of an upper end of each of said posts, said head portions being removable therefrom, g. said platform positionable between a normal outer position and an inner position, said inner position defined by contact of said platform and an object thereon with liquid within said container substantially adjacently positioned relative to the floor, said normal outer position defined by a spaced disposition of said platform and the object thereon from liquid within said container, and h. a plurality of projections formed on said platform and extending outwardly therefrom said outer exposed surface and collectively dimensioned to support the object thereon in spaced relation from said exposed surface of said platform whereby air can flow between said outer exposed surface and an undersurface of the object in drying relation thereto.

2. An assembly as in claim 1 wherein one of each of said springs is attached to a lower end of a respective one of said posts and an opposite end of each of said springs is disposed in supporting engagement with said platform.

3. An assembly as in claim 2 wherein each of said posts is disposed in aligned relation to one of a plurality of receiving openings formed in spaced relation to one another in said platform and dimensioned to pass through a respective one of said springs along a length of said posts as said platform passes between said outer and inner positions.

4. An assembly as in claim 2 wherein each of said posts include a mounting structure formed on said lower end thereof, said mounting structure configured to removably secure a lower most end of a respective spring thereto.

* * * * *